US011499346B2

(12) United States Patent
Martínez Alonso et al.

(10) Patent No.: US 11,499,346 B2
(45) Date of Patent: Nov. 15, 2022

(54) ELECTRONIC PADLOCK COVER WITH A KNOB

(71) Applicant: Salto Systems, S.L., Oiartzun (ES)

(72) Inventors: Ibon Martínez Alonso, Oiartzun (ES); Carlos Ferreira Sánchez, Oiartzun (ES)

(73) Assignee: Salto Systems, S.L., Guipuzcoa (ES)

( * ) Notice: Subject to any disclaimer, the term of this patent is extended or adjusted under 35 U.S.C. 154(b) by 181 days.

(21) Appl. No.: 16/906,317

(22) Filed: Jun. 19, 2020

(65) Prior Publication Data

US 2020/0399932 A1 Dec. 24, 2020

(30) Foreign Application Priority Data

Jun. 21, 2019 (ES) ..... ES201930567

(51) Int. Cl.
*E05B 67/00* (2006.01)
*E05B 67/38* (2006.01)
*E05B 67/02* (2006.01)

(52) U.S. Cl.
CPC ..... *E05B 67/38* (2013.01); *E05B 67/02* (2013.01)

(58) Field of Classification Search
CPC ..... E05B 67/00; E05B 67/02; E05B 67/38; E05B 67/04
USPC ..... 70/22, 24–29, 35, 51, 52, 54–56
See application file for complete search history.

(56) References Cited

U.S. PATENT DOCUMENTS

| | | | | |
|---|---|---|---|---|
| 4,286,445 | A | 9/1981 | Sills | |
| 2006/0065024 | A1* | 3/2006 | Gutierrez | E05B 67/02 70/56 |
| 2010/0039260 | A1* | 2/2010 | Bosin | E05B 37/0068 340/542 |
| 2010/0064738 | A1* | 3/2010 | Yi | E05B 67/02 70/24 |
| 2012/0011902 | A1* | 1/2012 | Meekma | E05B 47/0012 70/52 |
| 2018/0044946 | A1 | 2/2018 | Horton | |

FOREIGN PATENT DOCUMENTS

| | | | |
|---|---|---|---|
| CN | 203081105 | U | 7/2013 |
| CN | 205189548 | U | 4/2016 |
| CN | 208310451 | U | 1/2019 |
| EP | 2388418 | A2 | 11/2011 |
| JP | 200952370 | A | 3/2019 |
| MX | 2017002590 | A | 12/2017 |

(Continued)

*Primary Examiner* — Suzanne L Barrett
(74) *Attorney, Agent, or Firm* — The Webb Law Firm

(57) ABSTRACT

The invention relates to an electronic padlock cover with a knob, wherein the padlock includes a rotor assembly formed by an electronic cylinder joined in continuity to an electronic knob, a body wherein the cylinder and a padlock ring are housed, wherein the cover includes a protective casing of the body intended to surround and protect the body of the padlock on one end, a support with a ring-shaped configuration including two grooves and an extension, centered on each groove, which includes a pair of first holes for the introduction of corresponding fastening screws for fastening to the body of the padlock and a protective casing of the knob including two flanges located in correspondence with the grooves, including an inner cylindrical opening for the housing of the knob.

9 Claims, 5 Drawing Sheets

(56) References Cited

FOREIGN PATENT DOCUMENTS

| | | | | |
|---|---|---|---|---|
| WO | 2016192000 | A1 | 12/2016 | |
| WO | 2018184070 | A1 | 10/2018 | |
| WO | WO-2018184070 | A1 * | 10/2018 | ..... E05B 15/0073 |

* cited by examiner

ELECTRONIC PADLOCK COVER WITH A KNOB

CROSS-REFERENCE TO RELATED APPLICATION

This application claims priority to Spanish Patent Application No. P201930567 filed Jun. 21, 2019, the disclosure of which is hereby incorporated by reference in its entirety.

BACKGROUND OF THE INVENTION

Field of the Invention

The object of the present disclosure is an electronic padlock cover with a knob, the configuration and design of which give the padlock optimal protection against shocks, an improvement in the tightness of the assembly, protection against solid elements in suspension (sand, contamination, etc.) and better ergonomics.

Description of Related Art

Currently, there are two types of electronic padlocks which are used the most. On the one hand, there are electronic padlocks without a knob which have the electronics inside the padlock, for which reason to the naked eye the padlock is the same as a mechanical padlock without electronics. These padlocks require a key which is inserted into a hole of the padlock and by means of the contact between the pins of the key and the receivers in the hole, the electronics are activated and the padlock is opened.

On the other hand, there are electronic padlocks with a knob, these are mechanical padlocks where, instead of having a cylinder lock, a cylinder with an electronic knob is inserted into the housing enabled for said lock.

These electronic padlocks with a knob have two types of problems. On the one hand, the reading lid is very fragile and tends to break easily, especially if the padlock falls on the ground, since it is usually made of plastic in order to facilitate the reading by means of the opening device (a card or a mobile phone). In fact, these padlocks are subjected to break tests by letting them fall on a concrete floor from a certain height and the results obtained demonstrate that they currently withstand a very low number of falls, making it very difficult to overcome the regulations in this regard.

Moreover, electronic padlocks have a problem with tightness and resistance to inclement weather.

The usual application of this type of padlock is for protecting areas which are outdoors, for example, access to electrical substations located in the countryside, access to outdoor areas wherein fuel tanks are located, closures in lorry trailers, etc. In these applications, the padlock is in hostile environments subjected to shocks, vibrations, abrasive elements in suspension (sand), pollution, saltpetre, etc. In order to solve these problems, solutions based on improving the tightness between the knob and the body of the padlock are currently known in the state of the art, although these models are not usually shock-resistant.

Other solutions focus on protecting the knob from shocks without losing the objective of tightness, although they have ergonomic problems and are not usually very practical solutions. An example is one wherein the knob is inserted into a projection incorporated by the cover, sticking out of a window, which hinders the rotation of the knob. If we combine this with the fact that gloves must be used, for example, due to being in adverse weather conditions, the use thereof is very restricted.

SUMMARY OF THE INVENTION

In order to achieve the objectives and prevent the aforementioned drawbacks, the present disclosure describes an integral electronic padlock cover with a knob. The padlock comprises a rotor assembly formed by an electronic cylinder joined in continuity to an electronic knob, a body wherein the electronic cylinder and a closing ring of the padlock are housed. The knob has a cylindrical configuration and a cross section which can be oval, circular or have any other shape, and the base of the knob is a reading base for opening the padlock.

The cover is mainly formed by a protective casing of the body and a protective casing of the knob.

The protective casing of the body is intended to receive the body of the padlock on one end which comprises fastening elements and the other end of which includes a pair of holes for the movement of corresponding ends of the ring of the padlock.

Moreover, the protective casing of the knob comprises a space for housing the knob and is joined to the body of the padlock through an intermediate support.

In one embodiment, the protective casing of the knob is formed by a head solidly joined to a bushing by means of which the fastening of the protective casing of the knob to the body of the padlock is carried out.

In this case, for correct housing of the knob in the protective casing of the knob, the space of the head has the same cross section as the knob, e.g., oval or circular. Thus, when the protective casing of the knob is rotated to open the padlock, if the cross section is oval, the protective casing of the knob drags the knob. On the other hand, if the cross section is circular, the protective casing of the knob and the knob must incorporate a fastening with tongue and groove configuration such that the dragging of the knob when the protective casing of the knob is rotated is carried out by means of this fastening.

The support has a ring-shaped configuration and comprises two grooves and an extension, centred on each groove, which comprises a pair of first holes for the introduction of corresponding fastening screws for fastening the support to the body of the padlock.

The bushing incorporates two flanges located in correspondence with the grooves which, after being inserted therein and slightly rotating the bushing, enables the insertion of a locking screw through a second hole in one of the extensions and thereby prevents the flanges from coming out.

The cover preferably incorporates a return spring with the ends ending in pins for resting on corresponding projections located on the support and on the protective casing of the knob, respectively, such that when the protective casing of the knob is rotated in order to open the padlock, the spring subsequently returns it to the initial position thereof.

The head is preferably made of flexible material in order to improve shock absorption and can include inserts made of rigid material in order to provide the knob with dimensional stability and rigidity.

Furthermore, the free end of the head can incorporate a closing lid. Moreover, in order to facilitate the rotation of the knob, the head can incorporate a pair of fins.

BRIEF DESCRIPTION OF THE FIGURES

To complete the description of the disclosure, and for the purpose of helping to make the features thereof more readily understandable, according to a preferred exemplary embodiment thereof, a set of drawings is included where, by way of illustration and not limitation, the following figures have been represented.

A list of the references used in the figures is provided below:

1. Protective casing of the knob.
2. Head.
3. Bushing.
4. Return spring.
5. Support.
6. Knob.
7. Electronic cylinder.
8. Body of the padlock.
9. Protective casing of the body.
10. Grooves.
11. Extension.
12. First holes.
13. Screws.
14. Second hole.
15. Locking screw.
16. Flanges.
17. Fins.
18. Ring of the padlock.
19. Projection for dragging the spring.

DESCRIPTION OF THE INVENTION

The object of the present description is an electronic padlock cover with a knob, the configuration and design of which give the padlock optimal protection against shocks, an improvement in the tightness of the assembly and protection against inclement weather and better ergonomics.

Figure 1:
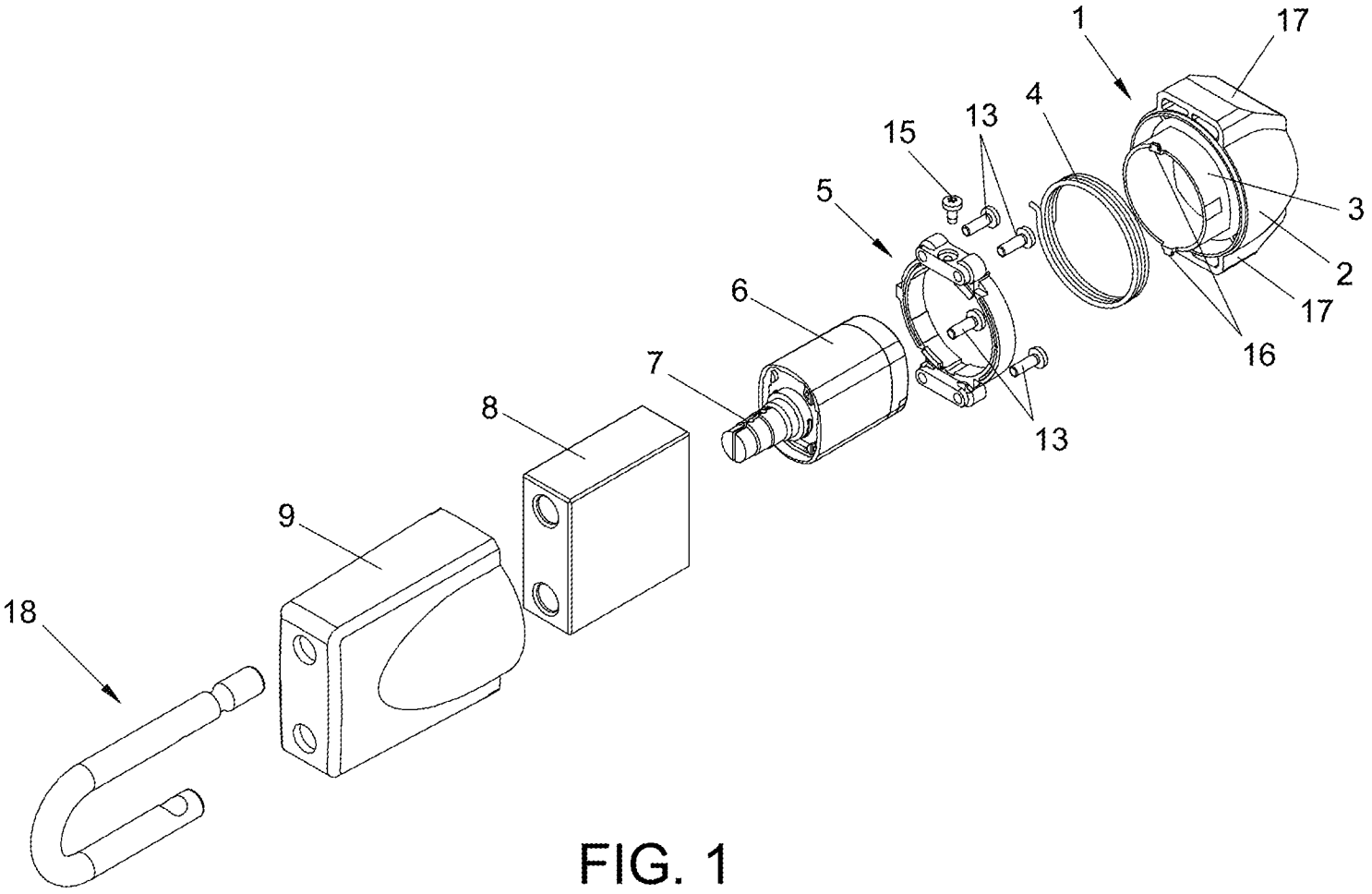
FIG. 1 represents an exploded view of the cover of the invention with the padlock it protects.

As shown in FIG. 1, the electronic padlock is basically formed by a body of the padlock (8) from which a padlock ring (18) comes out on one side and a rotor assembly on the other side. The rotor assembly, in turn, is formed by an electronic cylinder (7), which is inserted into the body of the padlock (8), joined in continuity to an electronic knob (6), which protrudes from the body (8) and is where the reading elements for opening the padlock are located.

The cover object of the invention comprises a protective casing of the body (9) and a protective casing of the knob (1).

Figure 2:
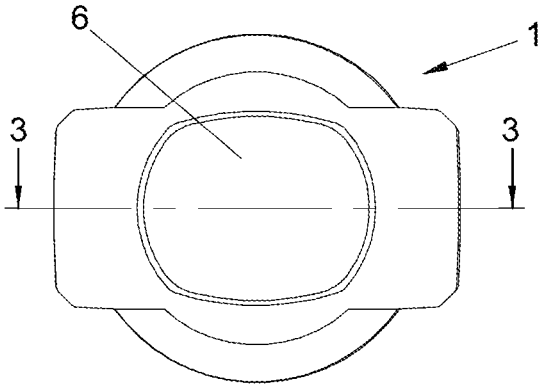
FIG. 2 represents a front view of the cover of the invention with the padlock inserted.
Figure 3:
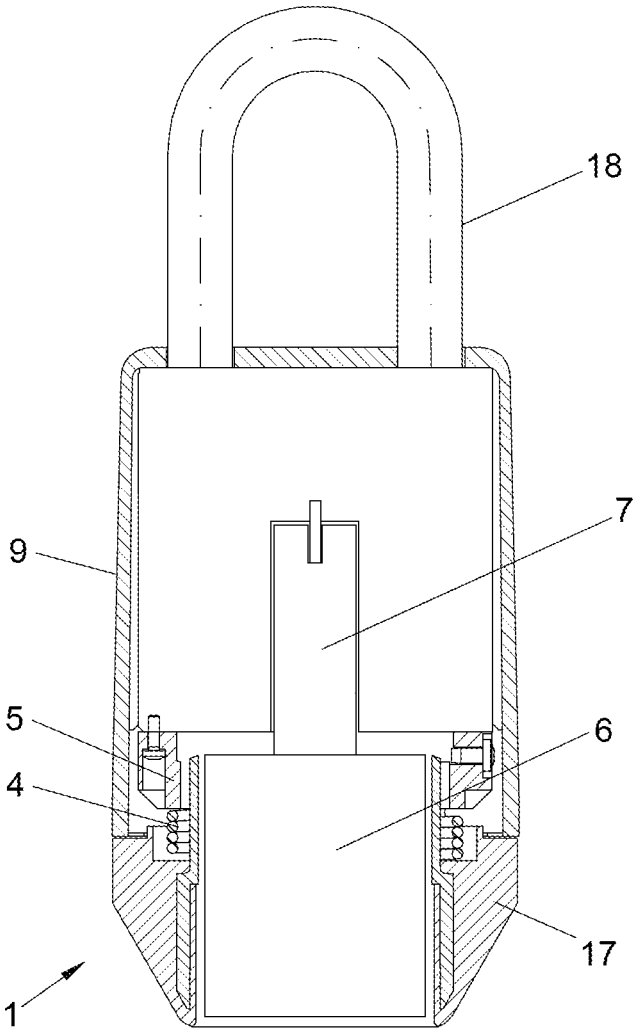
FIG. 3 represents a cross section of the view represented in FIG. 2 in order to show the internal elements in detail.

As shown in FIGS. 2 and 3, the protective casing of the body (9) is open on one end which houses the body of the padlock (8), the knob (6) remaining outside of the protective casing of the body (9). The other end of the protective casing of the body (9) includes a pair of holes through which the ends of the ring (18) move.

The protective casing of the knob (1) houses the knob (6) and is fastened to the body of the padlock (8) by means of a support (5), the electronic padlock being covered between the protective casing of the body (9) and the protective casing of the knob (1).

As for the fastening of the cover of the invention to the padlock, it is carried out as described below.

The body of the padlock (8) is housed inside the protective casing of the body (9), which incorporates fastening elements on the end in order to retain it in a fitted manner and without clearance by means of elastic deformation. This fastening element has not been represented in the figures as it can be any type known in the state of the art. The ring (18) comes out through holes on the other end.

It should be noted that the inside of the padlock, including both the fastening system of the ring (18), as well as the inside of the electronic cylinder (7) and the electronic knob (6) have not been represented as they are not a relevant part of the invention and make up part of the state of the art.

Figure 5:
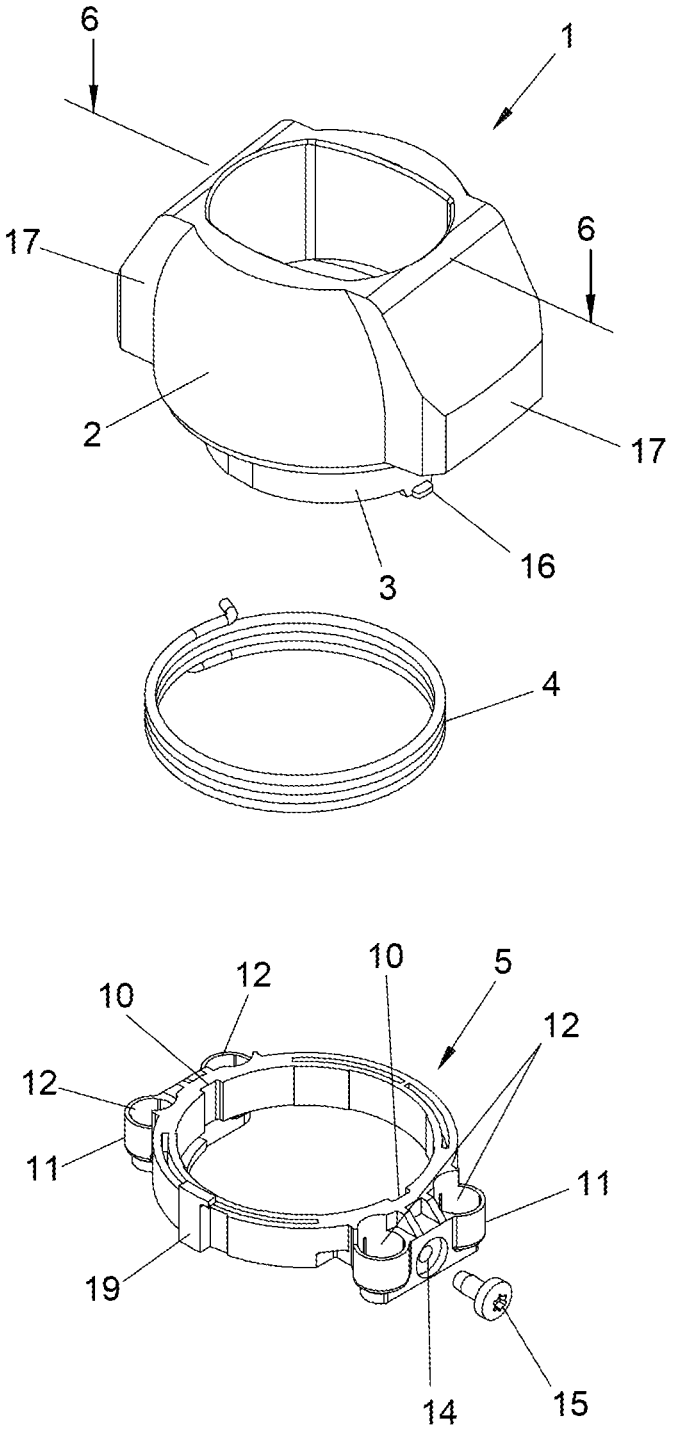
FIG. 5 is an exploded view of the protective casing of the knob and the support for fastening to the body of the padlock.
Figure 6:
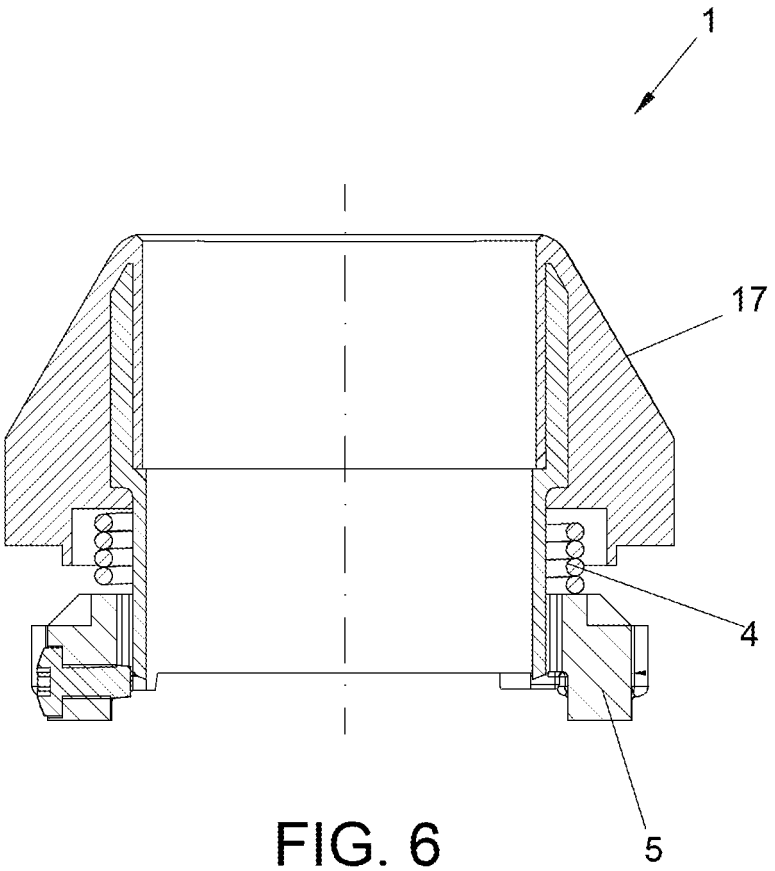
FIG. 6 represents a cross section of the protective casing of the knob represented in FIG. 5.

As shown in FIGS. 5 and 6, the support (5) is a part with a ring-shaped configuration comprising a pair of grooves (10) on the inside, located diametrically opposite from each other. On the outside, centred with each of the grooves (10), an extension (11) is located comprising a pair of first holes (12) for the insertion of screws (13) intended to be fastened in the body of the padlock (8) and thereby join the support (5) to the body (8).

In a preferred embodiment, the protective casing of the knob (1) is configured by means of a head (2) incorporating a through space, which incorporates a bushing (3) with a diameter slightly larger than the space. The bushing (3) incorporates a pair of flanges (16) which extend outwards. The space is intended to house the knob (6), wherein it is located.

In order to have the padlock in situations with different degrees of protection, the padlock can incorporate a lid which closes the opening of the head (2) and thereby provides tightness to the cover, preventing impurities from entering. The fact that this end is not closed improves reading in the opening of the padlock and allows accurate electronic reading to be carried out.

One of the extensions (11) incorporates a second hole (14), a through hole centred in the extension (11) and coinciding with the corresponding groove (10), intended to house a locking screw (15).

To fasten the support (5) to the protective casing of the knob (1), the flanges (16) are introduced into the grooves (10) and it is rotated slightly such that the flanges (16) release the grooves (10), which enables the positioning of the locking screw (15) in the second hole (14) and thereby houses it in the groove (10), preventing the protective casing of the knob (1) from decoupling from the support (5).

Since these are electronic padlocks, the manner of opening them is by means of presenting a key, consisting of a card, a mobile phone or similar, and subsequently rotating the protective casing of the knob (1), and therefore the knob (6).

Without a key or without the correct key, the protective casing of the knob (1) can freely rotate around the support (5) without opening the padlock. However, when the correct key is presented, when the knob (6) is rotated, it acts on the electronic cylinder (7) and engages with the opening mechanism of the padlock, opening the padlock.

To achieve the dragging of the knob (6) through the protective casing of the knob (1), it must be taken into account that if the knob (6) has a cross section other than the circular one, the very head (2) is responsible for dragging it in the rotational movement thereof. However, if the knob (6) has a circular cross section, the head (2) is also circular and, in order to have a dragging effect, there must be a fastening with a tongue and groove configuration that carries it out. In this case, the head (2) incorporates a projection which fits into a slit located in the knob (6), although the tongue and groove configuration can also be located in the opposite manner. This fastening has not been represented in the figures because it can be any fastening known in the state of the art.

To return the protective casing of the knob (1) to the initial position thereof, once the padlock has been opened, a return spring (4) located in the innermost portion of the bushing (3) is included between the protective casing of the knob (1) and the support (5), for which reason it has a cylindrical shape with the ends thereof ending in corresponding pins. One of the pins stays in contact with a projection incorporated by the protective casing of the knob (1), while the other pin makes contact with a projection for dragging the spring (19) incorporated by the support (5), making a stop between both projections. To prevent clearance, the return spring (4) is positioned between these two projections with a preload. Thus, it forces an initial position between the protective casing of the knob (1) and the support (5). In this manner, when the protective casing of the knob (1) is rotated, it moves the corresponding pin of the return spring (4), loading the spring and, when the protective casing of the knob (1) is released, the return spring (4) is unloaded in order to return the protective casing of the knob (1) to the initial position thereof.

Figure 4A:
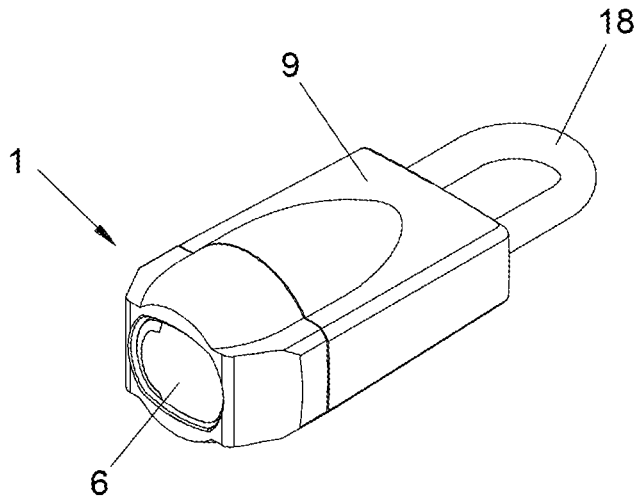
FIG. 4*a* represents a perspective view of the cover of the invention with the padlock in the closed position.
Figure 4B:
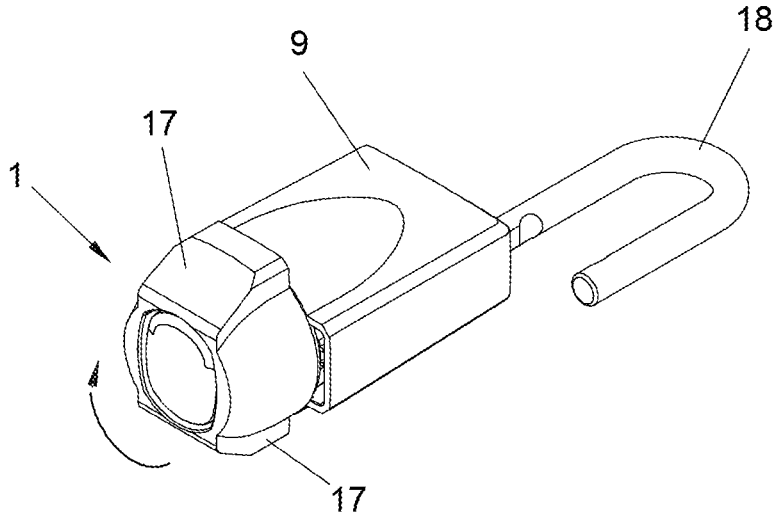
FIG. 4*b* represents a perspective view of the cover of the invention with the padlock in the open position after having rotated the protective casing of the knob ninety degrees.

As shown in FIGS. 4*a* and 4*b*, to facilitate the rotation of the protective casing of the knob (1), the head (2) preferably incorporates a pair of fins (17) by means of which better ergonomics are provided for the rotational movement of the protective casing of the knob (1) and, therefore, the opening of the padlock.

Moreover, in order to improve the shock absorption of the cover of the invention, the head (2) of the protective casing of the knob (1) is preferably made of a flexible material such that, without the protective casing of the knob (1) losing the stiffness properties required by the mechanical part, formed by the bushing (3) and the components thereof, the head (2), as a part exposed to the outside, has a high capacity to absorb the shocks produced, especially from possible falls. Likewise, the head (2) can incorporate inserts made of rigid material which provide dimensional stability and increase shock resistance. Furthermore, it must be considered that the knob (6) is not in contact with the protective casing of the knob (1), there being a clearance, which provides additional security against breakage due to the shocks. The head (2) is overinjected on the bushing (3)

To carry out continuity between the protective casing of the knob (1) and the protective casing of the body, the protective casing of the body (9) incorporates a widening which configures a circular geometry in order to adapt to the configuration of the protective casing of the knob (1). To increase protection, a tongue and groove overlap is produced between both parts which hinders the inlet of impurities (sand, dust, etc.) and even water.

Lastly, it must be indicated that the present invention must not be limited to the embodiment described herein. Other configurations may be carried out by those skilled in the art based on the present description. Accordingly, the scope of the invention is defined by the following claims.

The invention claimed is:

1. An electronic padlock cover with a knob for a padlock, wherein the padlock comprises a rotor assembly formed by an electronic cylinder joined in continuity to an electronic knob, and a body in which the cylinder and a padlock ring are housed, the electronic knob incorporating a reading base for an opening of the padlock, wherein the cover comprises:

a protective casing of the body intended to protect the body of the padlock, and a protective casing of the knob, comprising an inner space for housing the knob wherein:

the protective casing of the knob is configured to be fastened to the body of the padlock through a support and is formed by a head solidly joined to a bushing.

2. The electronic padlock cover with a knob, according to claim 1, wherein the support has a ring-shaped configuration and comprises two grooves and an extension, centered on each groove, which comprises a pair of first holes for the introduction of corresponding fastening screws intended to fasten the support to the body of the padlock.

3. The electronic padlock cover with a knob, according to claim 2, wherein the protective casing of the knob comprises two flanges located in correspondence with the grooves.

4. The electronic padlock cover with a knob, according to claim 3, wherein a bushing is configured to be coupled to the support by inserting the flanges into the grooves, subsequent rotation and location of a locking screw in a second hole in order to prevent decoupling between the protective casing of the knob and the body of the padlock.

5. The electronic padlock cover with a knob, according to claim 1, further comprising a return spring with the ends ending in pins for resting on corresponding projections located on the support and on the protective casing of the knob, respectively.

6. The electronic padlock cover with a knob, according to claim 1, wherein the head is made of flexible material in order to improve shock absorption and the bushing is made of rigid material in order to reinforce the protective casing of the knob.

7. The electronic padlock cover with a knob, according to claim 1, wherein a free end of the head incorporates a closing lid.

8. The electronic padlock cover with a knob, according to claim 1, wherein the head comprises a pair of fins in order to facilitate rotation of the protective casing of the knob.

9. The electronic padlock cover with a knob according to claim 1, wherein if the knob has a circular cross section, the knob incorporates one component of a tongue and groove fastening and the head incorporates another component of the fastening such that, when the head is rotated, the knob is dragged in the movement thereof.

* * * * *